United States Patent [19]

Faber

[11] 4,010,079

[45] Mar. 1, 1977

[54] COKE OVEN CHARGING GAS CLEANING AND COLLECTING APPARATUS AND PROCESS

[75] Inventor: Paul V. Faber, Morristown, N.J.

[73] Assignee: Wilputte Corporation, Murray Hill, N.J.

[22] Filed: Feb. 19, 1975

[21] Appl. No.: 551,020

Related U.S. Application Data

[63] Continuation-in-part of Ser. No. 392,873, Aug. 30, 1973, abandoned.

[52] U.S. Cl. ..... 201/4; 202/254; 202/256; 202/260; 202/263

[51] Int. Cl.[2] ..... C10B 27/04; C10B 27/06

[58] Field of Search ..... 201/40, 4, 29, 30; 202/254, 255, 257, 260, 263, 197, 256

[56] References Cited

UNITED STATES PATENTS

| | | | |
|---|---|---|---|
| 162,625 | 4/1875 | Cathell | 202/256 |
| 2,218,916 | 10/1940 | Koppers | 202/255 |
| 2,975,109 | 4/1961 | Van Ackeren | 202/109 |
| 3,764,482 | 10/1973 | Yoshida | 201/40 |
| 3,804,721 | 4/1974 | Gidick | 202/256 |
| 3,956,073 | 5/1976 | Carbone | 202/254 |

*Primary Examiner*—Hiram H. Bernstein
*Attorney, Agent, or Firm*—Buell, Blenko & Ziesenheim

[57] ABSTRACT

Apparatus and process for removing coal dust from gases evolved from coke ovens while they are being charged comprehends a common duct for both charging gas and coking gas leading to a common gas collecting main, means in the duct for spraying the charging gas with a charging liquor to scrub out solid particles therefrom, means in the duct for spraying the coking gas with flushing liquor, and means for withdrawing liquor and solid particles from that duct.

7 Claims, 3 Drawing Figures

COKE OVEN CHARGING GAS CLEANING AND COLLECTING APPARATUS AND PROCESS

This application is a continuation-in-part of application Ser. No. 392,873, filed Aug. 30, 1973 now abandoned.

This invention relates to apparatus for treating gases evolved from by-product coke ovens. It is more particularly concerned with apparatus for treating gases evolved during charging of the ovens and removing solid particles entrained in those gases so as to make possible collection of the treated gas with the coking gas.

Modern by-product coke oven batteries are conventionally constructed in the form of a large number of relatively narrow ovens positioned side-by-side. The coke oven gas evolved during the coking operation is collected from the top of each oven by a standpipe, or ascension pipe, as it is sometimes called, which projects vertically above the top of the oven and connects through an elbow with a coke oven gas main which runs along the battery. Some types of batteries have a single standpipe for each coke oven located at one end and a single coke oven gas collecting main. Others have a standpipe at each end of each oven and a gas collecting main running along each side of the battery.

Into the downcomer connecting the standpipe elbow with the gas collecting main is sprayed a liquid known as flushing liquor, and it is also conventional to spray flushing liquor into the gas collecting main. This liquor is sprayed in amounts sufficient to cool the coke oven gas and cause precipitation of tars therefrom. It is an aqueous weakly ammoniacal liquor which is the condensate from the volatile products given off in the coking process. Flushing liquor is circulated through apparatus to recover ammonia and to separate tars therefrom and back to the sprays, so that its composition at any given point in the system is essentially constant.

Each oven has several charging holes with covers in its roof through which raw coal is introduced. When the coal makes contact with the hot oven refractories quantities of volatile constituents and entrained solids are suddenly evolved. These gases and solids are largely carried over into the gas collecting main, although some escape into the atmosphere. The presence of coal dust above a relatively low level in the gas going to the by-product plant is quite undesirable as those solids clog the spray outlets for recirculated liquor in the by-product system and degrade the recovered coal tar by raising its ash and moisture contents. It has been standard practice to wet the coal before charging to reduce the carry-over of coal dust into the gas collecting main and to reduce the quantity of gases and solids emitted into the atmosphere. It is not possible, however, by these means to eliminate discharge of those constituents.

Environmental considerations now require that the discharge of those gases and solids into the atmosphere be prevented, and various closed charging systems have been devised to this end. One such system is pipeline charging in which the coal is fluidized and transported through a pipe into the oven by a carrier gas. This operation, however, requires dry coal and in practice the coal is usuallly preheated to a temperature of about 500° F. Thus, the quantity of coal dust and other suspended solids resulting from pipeline charging is considerably greater than that from conventional wet coal charging, and, although some of the carrier gas is usually bled off before it enters the oven, the volume of gases to be accommodated is substantially increased. These factors combine to raise the solids content of the gas evolved during charging well above a level that can be accepted by the coke oven gas.

One proposed solution to the problems above mentioned is disclosed in U.S. Pat. No. 3,804,721, issued to W. F. Gidick on Apr. 16, 1974. Gidick's apparatus utilizes a gas collecting main provided with a longitudinally extending upright partition and a modified or a specially designed liquor seal valve intended to direct gases from the oven to one side or the other of the partition. Modification of existing installation in the way shown by Gidick is generally rather difficult and expensive to accomplish.

It is an object of my invention to provide improved by-product coking battery apparatus which flushes or scrubs entrained solids out of the gases evolved during charging so as to permit the charging gas to be collected with the coking gas in a conventional coking gas collecting main. It is another object to provide such apparatus which collects the liquor used to scrub the charging gas separately from the conventional flushing liquor. It is yet another object to provide such apparatus which requires merely minor modification of existing installations. Other objects of my invention will become apparent in the course of the description thereof which follows:

I accomplish the objects above mentioned by providing separate sources of flushing liquor for the gases evolved during coking and flushing or scrubbing liquor for the gases evolved during charging. The latter liquor I denominate "charging liquor". I inject that charging liquor into the gas passing from the standpipe or ascension pipe into the gas collecting main and provide means for drawing off the charging liquor and solids contained therein before it reaches the gas collecting main, while permitting the scrubbed charging gas to pass into the gas collecting main.

Two embodiments of my invention presently preferred by me are illustrated in the attached Figures to which reference is now made.

Figure 1:
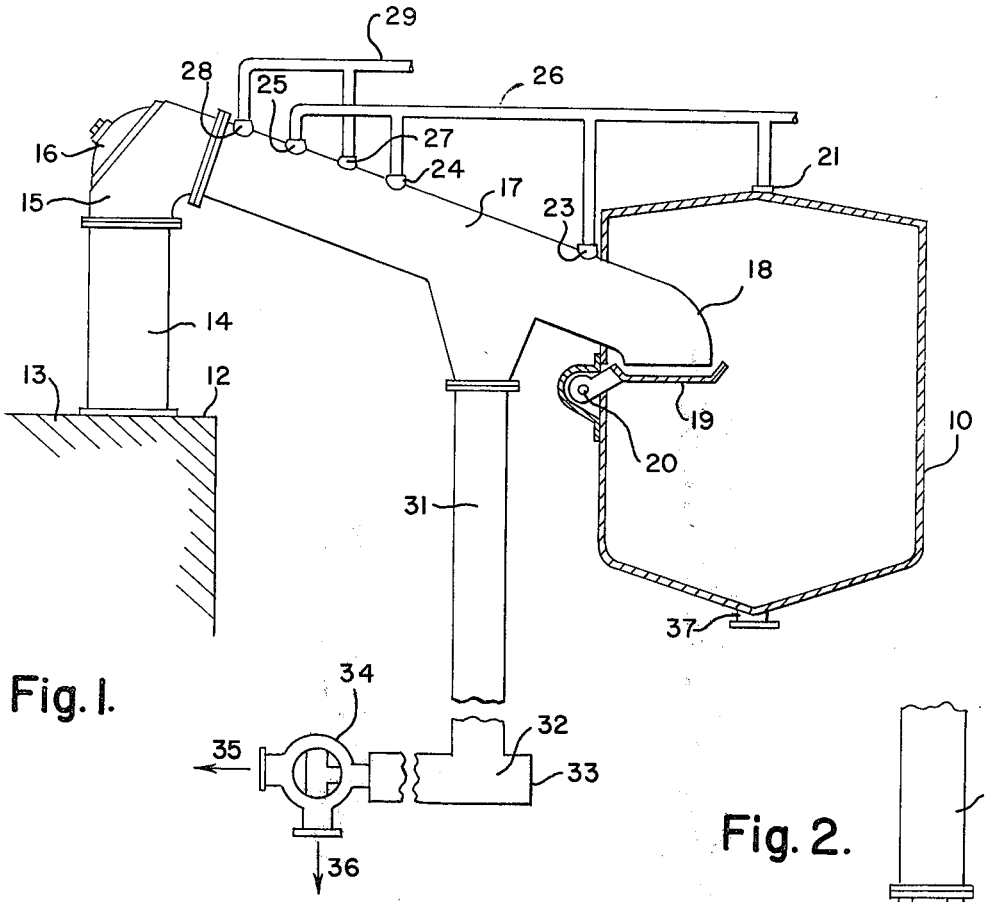
FIG. 1 is a diagrammatic sketch of an embodiment in which the contaminates removed from the gases evolved during charging are drained off through a pipe or duct and collected separately from the flushing liquor and the cleaned gases evolved during charging are collected with the coking gas in a coking gas main.

In the embodiment of FIG. 1 an upright standpipe 14 vents a coke oven 13 through its roof 12. Standpipe 14 is connected to elbow 15 which is provided with a cover 16. Elbow 15 leads into a downcomer pipe 17, the discharge end 18 of which opens downwardly inside coking gas collecting main 10. Discharge end 18 is provided with a conventional liquor seal valve 19, which is pivoted to open and close around pivot 20.

Gas collecting main 10 is provided with a spray nozzle 21 in its upper wall. Downcomer pipe 17 is likewise provided with spray nozzles 23, 24, and 25 spaced along its length in its upper wall. These nozzles 21, 23, 24 and 25 are supplied with flushing liquor through a pipe 26. Downcomer pipe 17 is also provided with spray nozzles 27 and 28 in its upper wall near elbow 15 and those nozzles are supplied with charging liquor through a pipe 29.

Intermediate collecting main 10 and the group of spray nozzles 24, 25, 27 and 28, an offtake pipe 31 extends downwardly from downcomer pipe 17 and terminates at its lower end in a tee 32 having a cleanout door 33 at one end, and a conventional three-way valve 34 connected to its other end. Valve 34 has two discharge ports 35 and 26, the first of which connects with charging liquor recovery means, not shown, and the second of which connects with flushing liquor recovery means, also not shown. Collecting main 10 has a flushing liquor drain 37 in its bottom which is likewise connected with flushing liquor recovery means.

Both coke oven gas and the gas evolved during charging from oven 13 pass through standpipe 14 and elbow 15 into downcomer pipe 17 and from it into gas collecting main 10. During the coking period conventional flushing liquor is supplied to pipe 26 and sprayed into the coking gas through spray nozzles 21, 23, 24 and 25. Valve 34 is adjusted to connect offtake pipe 31 with discharge port 36. Valve 19 in gas main 10 is open. The gas passes into collecting main 10 and the flushing liquor, together with contaminates it has collected from the gas, drains out through offtake 31 and through drain 37, and is collected in a flushing liquor recovery system. During the charging period the source of flushing liquor to pipe 26 is cut off. Charging liquor is introduced into pipe 29 and sprayed into the charging gas through sprays 27 and 28. Those sprays may be designed to inject charging liquor into the charging gases so as to scrub out the solid particles entrained therein. The charging liquor so introduced together with those solid particles drains through offtake pipe 31, but valve 34 is adjusted so that the liquor is discharged through port 35 into a charging liquor recovery system.

The charging liquor is initially water. It picks up some ammonia and tars from the charging gas, but as charging conditions are quite different from coking conditions and the time required for charging, during which the charging liquor flows, is only a fraction of the coking time, during which flushing liquor flows, the composition of the charging liquor is substantially different from the composition of the flushing liquor. It is not desirable to mix the two because mixing tends to degrade the conventional process of recovering ammonia and separating tars from flushing liquor.

Figure 2:
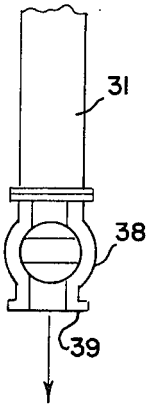
FIG. 2 is a detail showing a modification of a portion of the apparatus of FIG. 1.

The apparatus previously described, as modified into a somewhat simpler form, is illustrated in FIG. 2. Three-way valve 34 is replaced by a conventional open and closed valve 38, the outlet port 39 of which discharges into a charging liquor recovery system, not shown. This valve is moved to its closed position during coking. The flushing liquor introduced through pipe 26 then fills uptake 31 and overflows through discharge end 18 of downcomer pipe 17 into gas collecting main 10 and escapes through drain 37. When the oven is being charged valve 38 is opened and the charging liquor introduced through pipe 29 drains out of port 39 to the charging liquor recovery system as before.

Figure 3:
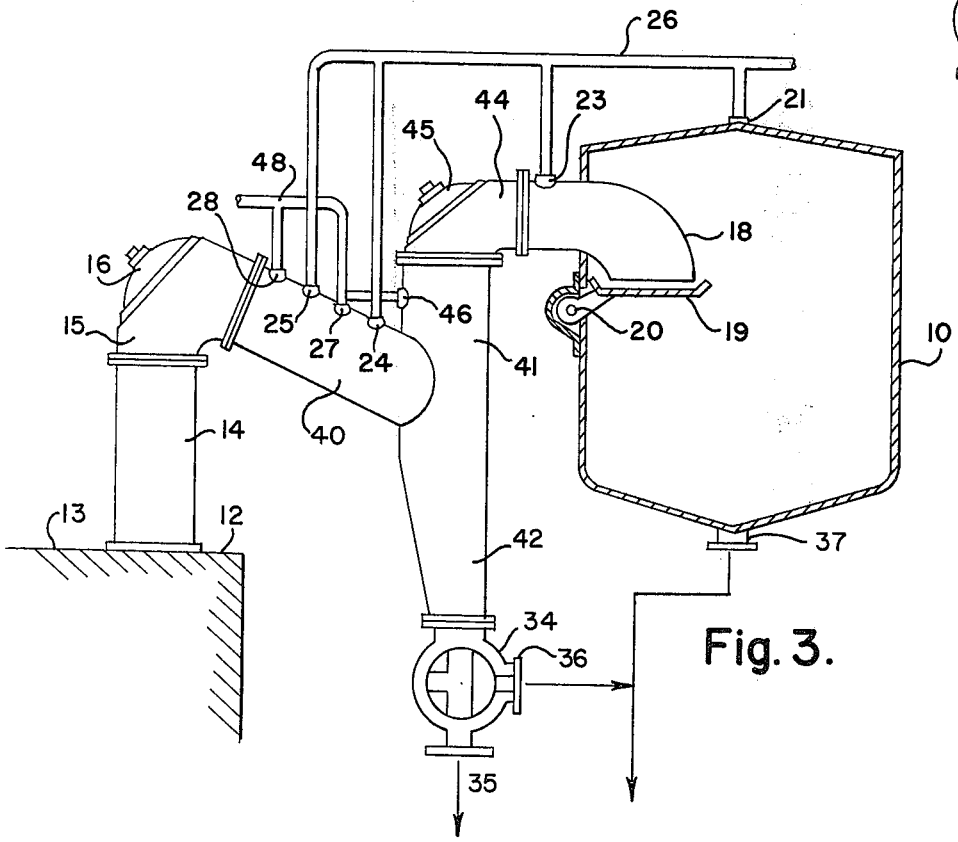
FIG. 3 is a diagrammatic sketch of a modification of the apparatus of FIG. 1 adapted to installations where the space between the standpipe and the gas collecting main is limited.

The apparatus of FIG. 3 includes many of the elements of FIG. 1 which are identified by the same reference characters applied to them in that Figure. The standpipe 14 is connected by elbow 15 to a downcomer pipe 40 which leads to a vertical duct having a portion 41 extending above pipe 40 and a portion 42 extending below pipe 40. This depending portion 42 terminates in a three-way valve 34 like that of FIG. 1, which has a discharge port 35 connecting with charging liquor recovery means, not shown, and discharge port 36 connecting with flushing liquor recovery means, also not shown. Upper portion 41 is connected to an elbow 44 having an elbow cover 45, which elbow in turn is connected to downwardly opening discharge pipe 18 which extends into gas collecting main 10. This discharge pipe is provided with a conventional liquor seal valve 19 which pivots about point 20. As before, a spray nozzle 21 is located in the roof of gas collecting main 10, another spray nozzle 23 is positioned in the upper wall of discharge pipe 18, and additional spray nozzles 24 and 25 are located in the upper wall of downcomer pipe 40. All those nozzles are supplied with flushing liquor by pipe 26. In addition, one or more spray nozzles 46 are positioned in duct 41 above its junction with downcomer 40. Charging liquor sprays 27 and 28 are positioned in the upper wall of downcomer pipe 40 and are supplied with this liquor through pipe 48. Nozzle 46 is also connected with pipe 48. Gas collecting main 10 has a drain 37 in its bottom wall which connects with the flushing liquor recovery means previously mentioned.

The operation of the apparatus of FIG. 3 is similar to that of FIg. 1. In addition, duct 41 and its associated charging liquor spray nozzle 46 acts as a gas washer or scrubber, washing out solids from the ascending stream of gas evolved during charging and assisted by maximum gravity separation. Those solids fall into duct 42 and are drawn off to the charging liquor recovery means.

In cramped installations the upright duct 41 may be extended and some or all spray nozzles 24, 25, 27, 28 positioned in the wall thereof like nozzle 46. It will be understood that in both embodiments I have described the number of nozzles for spraying flushing liquor and the number of nozzles for spraying charging liquor is illustrative only. As many nozzles may be employed for those purposes as are required. It will also be understood that it is not essential to turn off the flushing liquor during charging of the oven. The flushing liquor which continues to flow during that period dilutes the charging liquor and, of course, does not pass through the ammonia and tar recovery apparatus, but as the charging period is relatively short those consequences are not too significant.

As I have mentioned conventional coke oven batteries require only minor modification to embody my invention. The installation of scrubbing nozzles 27, 28 and 46 and their associated piping is easily accomplished. The same is true of offtake pipe 31 which need only be large enough to accommodate the charging liquor injected through the nozzles above mentioned together with the solid particles they wash out of the gas. No alterations to the gas collecting main 10 and liquor seal valves 19 are necessary.

In the foregoing specification I have described presently preferred embodiments of this invention, however, it will be understood that this invention can be otherwise embodied within the scope of the following claims.

I claim:

1. In a by-product coke oven battery comprising a plurality of coke ovens, a coking gas collecting main, a standpipe opening out of the top of each oven and comprising a vertical portion, a laterally extending portion and a terminal portion discharging through first liquor seal valve means into the coking gas collecting main, and means for introducing flushing liquor into the gas in the standpipe, the improvement comprising means for injecting charging liquor separate from the flushing liquor into the gases in the standpipe, an offtake pipe for liquor and solid particles only separate from the coking gas collecting main opening downwardly out of the laterally extending portion of the standpipe upstream of and adjacent the terminal portion thereof, and downstream of the means for injecting charging liquor and second valve means in the offtake pipe discharging into a charging liquor collecting main.

2. Apparatus of claim 1 in which the second valve means has two discharge ports connected respectively to a charging liquor collecting main and a flushing liquor collecting main.

3. Apparatus of claim 1 in which the means for injecting charging liquor are positioned so that charging liquor drains from the standpipe into the liquor offtake pipe.

4. Apparatus of claim 1 in which the liquor offtake pipe projects upwardly to form a vertical duct having an upper end extending above the laterally extending portion of the standpipe, the terminal portion of the standpipe is connected with the upper end of the duct, and including charging liquor injecting means positioned to inject charging liquor into the duct transversely thereof above its junction with the laterally extending portion of the standpipe so as to scrub solid particles out of the charging gas passing therethrough.

5. Apparatus of claim 1 in which at least one of the means for introducing flushing liquor into the standpipe is positioned in the upper wall of the laterally extending portion of the standpipe intermediate the liquor seal valve means and the liquor offtake pipe.

6. In the treatment of gases from coke ovens including the steps of spraying the coking gas with flushing liquor and spraying the charging gas with charging liquor, the improvement comprising passing charging gas and coking gas sequentially along a common path into a common collecting main, spraying the coking gas in that path with flushing liquor, spraying the charging gas in that path with charging liquor so as to scrub solid particles therefrom, drawing off charging liquor and solid particles from the charging gas in that path into a single stream before the charging gas enters the common collecting main, and drawing off flushing liquor from the coking gas in that common collecting main.

7. The process of claim 6, including passing the gases through an upwardly extending portion of the common path; injecting sprays of charging liquor into the gases in that portion of the path, and drawing off the charging liquor and solid particles only from the lower end of the upwardly extending portion of that path.

* * * * *

UNITED STATES PATENT OFFICE
CERTIFICATE OF CORRECTION

PATENT NO. : 4,010,079
DATED : March 1, 1977
INVENTOR(S) : PAUL V. FABER

It is certified that error appears in the above-identified patent and that said Letters Patent are hereby corrected as shown below:

Column 3, line 11, the numeral "26" should read --36--.

Column 4, line 27, "FIg." should read --FIG.--.

Signed and Sealed this

Third Day of May 1977

[SEAL]

*Attest:*

RUTH C. MASON
*Attesting Officer*

C. MARSHALL DANN
*Commissioner of Patents and Trademarks*